United States Patent [19]

Adell et al.

[11] Patent Number: 5,063,940

[45] Date of Patent: Nov. 12, 1991

[54] MOUTHGUARD PACKAGING

[76] Inventors: Loren S. Adell; Michael Adell, both of 200 Adell Blvd., Sunnyvale, Tex. 75182

[21] Appl. No.: 427,823

[22] Filed: Oct. 26, 1989

[51] Int. Cl.[5] ..... A61C 5/14

[52] U.S. Cl. ..... 128/861; 206/822; 206/438; 206/470; 206/63.5

[58] Field of Search ..... 206/822, 831, 83, 315.1, 206/438, 476, 491, 492, 562–564, 470, 63.5, 490, 480, 462, 463, 471; 128/860–862

[56] References Cited

U.S. PATENT DOCUMENTS

| | | | |
|---|---|---|---|
| 1,454,888 | 5/1923 | Green | 206/831 X |
| 2,125,313 | 8/1938 | Ringler | 206/831 X |
| 2,672,273 | 3/1954 | Smith | 206/831 X |
| 3,314,592 | 4/1967 | Streich | 206/831 X |
| 4,044,762 | 8/1977 | Jacobs | 128/861 |
| 4,046,251 | 9/1977 | Bruml | 206/476 X |
| 4,232,816 | 11/1980 | Johnson et al. | 206/831 X |
| 4,308,986 | 1/1982 | Parrilli | 206/470 |
| 4,383,607 | 5/1983 | Lordahl et al. | 206/470 X |
| 4,666,037 | 5/1987 | Weissman | 206/83 X |
| 4,697,700 | 10/1987 | Weissman | 206/63.5 X |

FOREIGN PATENT DOCUMENTS

| | | | |
|---|---|---|---|
| 1124150 | 6/1956 | France | 206/462 |

OTHER PUBLICATIONS

Packaging, vol. 31, No. 9, p. 53, 8/1986, Alloyd Co. advertisement.

Flex Guard Packaged Mouthguard, 1989.

*Primary Examiner*—Robert A. Hafer

*Assistant Examiner*—Kevin G. Rooney

*Attorney, Agent, or Firm*—George L. Boller

[57] ABSTRACT

A mouthguard that has an integral tethering strap is packaged by forming a loop at the distal end of the strap and then folding the strap back over the front of the U-shaped mouthguard body so as to nest the loop within the U-shaped body. The mouthguard is then ensealed in a transparent plastic clamshell enclosure. The enclosure is assembled to a paperboard carrier which contains cut-outs that are symmetrical about a line of folding for a flap portion of the carrier. When the flap is folded back onto the carrier, the margin of the clamshell is trapped. A second flap opposite the first one is also folded back onto the same side of the carrier as the first flap. The opposing faces of this second flap and the carrier contain a warranty card and a warranty certificate.

20 Claims, 3 Drawing Sheets

MOUTHGUARD PACKAGING

BACKGROUND AND SUMMARY OF THE INVENTION

This invention relates to new and unique packaging for a mouthguard.

Mouthguards are typically used in athletic activities, contact sports in particular, and are intended to protect the teeth and surrounding facial bone structure. A typical mouthguard has a generally U-shaped construction, and where it is intended for use in playing football, it also includes an integral strap that allows for tethering to the facebar of a football helmet. The mouthguard and its integral tether are fabricated by molding techniques, and where mouthguards are manufactured on a mass production basis for merchandising in commerce, it is important that the mouthguards be suitably packaged. Such packaging must provide suitable sealing of the mouthguard to keep it unexposed to the outside environment, and the packaging must provide certain information about the product. These attributes are especially desirable where the mouthguards are to be sold in retail outlets, such as in the sporting goods departments of department stores.

The present invention relates to mouthguard packaging which provides a number of useful features. Perhaps most importantly, it is constructed to provide the prospective purchaser with assurance that the packaging has not been tampered with. It also provides a compact enclosure for the mouthguard, yet one which is transparent so that the mouthguard can be seen by the prospective purchaser. The packaging further comprises a paperboard carrier for the transparent mouthguard enclosure. The carrier entraps the mouthguard enclosure and serves to convey information about the mouthguard. The information is printed onto the carrier, and the carrier has a unique arrangement by which information is presented. Information about the mouthguard features is presented on one side of the carrier, and warranty information is presented on the other. The warranty information is arranged to be enclosed by folding a flap of the carrier back against the carrier and sealing the perimeter of the flap to the carrier. In this way the warranty registration card and the specifics of the warranty cannot be defaced or altered before purchase. This flap, when folded back against the carrier, overlaps an opposing flap that has been folded back against the carrier to entrap the transparent enclosure. Thus tampering with the product is intended to be self-evident from examination of the packaging. The mouthguard enclosure is also constructed in a unique way to receive the mouthguard.

The foregoing features, advantages, and benefits of the invention, along with additional ones, will be seen in the ensuing description and claims which should be considered in conjunction with the accompanying drawings. The drawings disclose a preferred embodiment of the invention according to the best mode contemplated at the present time for carrying out the invention.

DESCRIPTION OF THE PREFERRED EMBODIMENT

Figure 1:
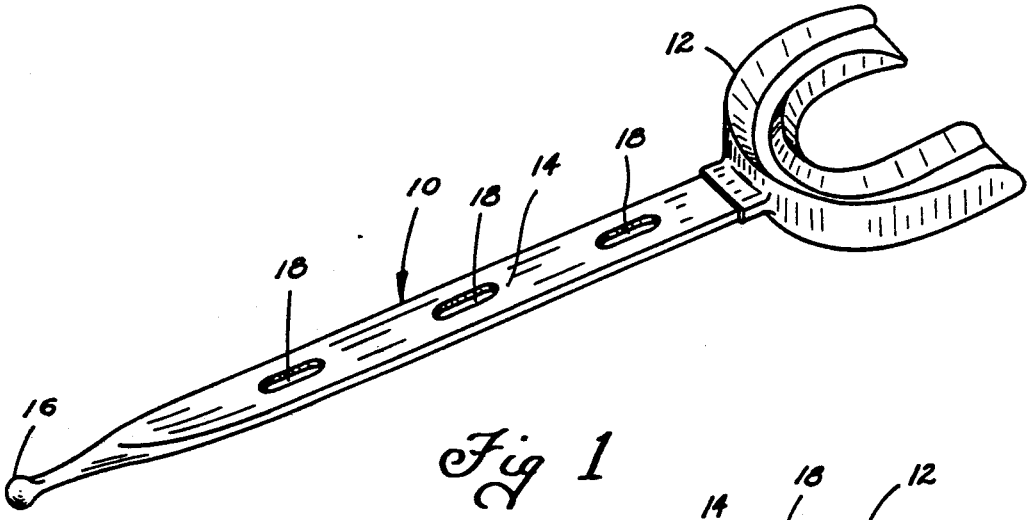
FIG. 1 is a perspective view of a mouthguard as manufactured.

FIG. 1 shows a mouthguard 10 having a main body 12 of general U-shape for fitting into the mouth. At the front of main body 12 there is an integral strap 14 by which the mouthguard can be tethered on the facebar of a football helmet. The mouthguard material has a certain flexibility that allows strap 14 to be looped in the manner shown in FIG. 2 for nesting with respect to main body 12.

Figure 2:
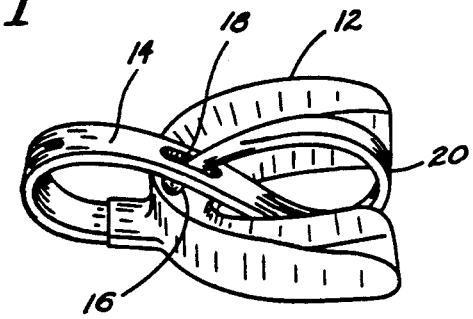
FIG. 2 is a perspective view of the mouthguard illustrating how it is configured in preparation for being packaged.
Figure 3:
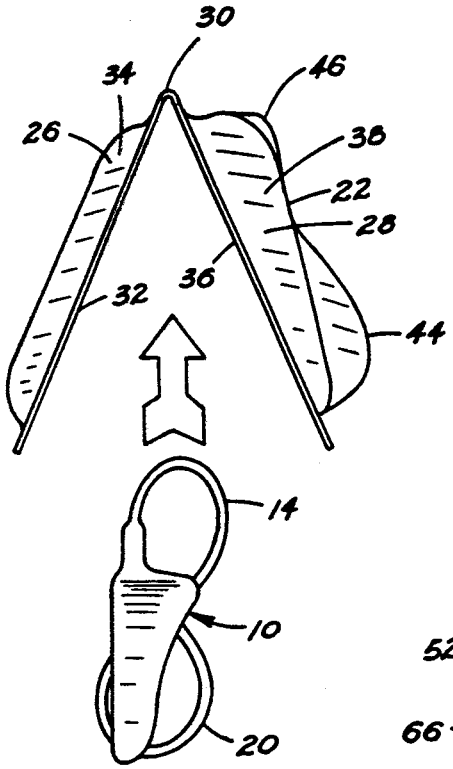
FIG. 3 is a view illustrating part of the packaging and how the mouthguard of FIG. 2 is placed into this part of the packaging.

To configure the mouthguard to the configuration of FIG. 2, the ball tip 16 at the distal end of strap 14 is passed through the second of three slots 18 that are formed in the strap at spaced apart intervals. The ball tip is passed through the slot from bottom to top as viewed in FIG. 1. Although the ball end has an interference fit with the slot, the flexibility of the material allows it to pass through the slot. This creates a loop 20 (FIG. 2) that conveniently nests in the U-shaped main body when the strap is looped back over the upper front of the main body. As a consequence, the mouthguard configuration of FIG. 2 is compactly configured for packaging.

The packaging comprises two parts. One of these parts is a clamshell 22 and the other is a carrier 24. Preferably the clamshell is fabricated from a transparent plastic while the carrier is fabricated from paperboard of suitable stiffness.

Clamshell 22 is fabricated by conventional forming techniques. The two halves of the clamshell are designated 26 and 28 respectively, and they are joined by a line of folding 30. The clamshell half 26 is designed to receive approximately the lower half of the mouthguard as it appears in FIG. 2 while the clamshell half 28 is designed to receive the upper half of the mouthguard. Clamshell half 26 comprises a flat margin 32 that peripherally bounds a cavity 34 for the lower half of the mouthguard. Clamshell half 28 comprises a flat margin 36 that peripherally bounds a cavity 38 for the upper half of the mouthguard. When the mouthguard is placed between the two halves of the clamshell and the two halves of the clamshell are folded together about line 30, the two margins 32, 36 come together and may be joined in a manner that hermetically encloses the mouthguard.

Figure 7:
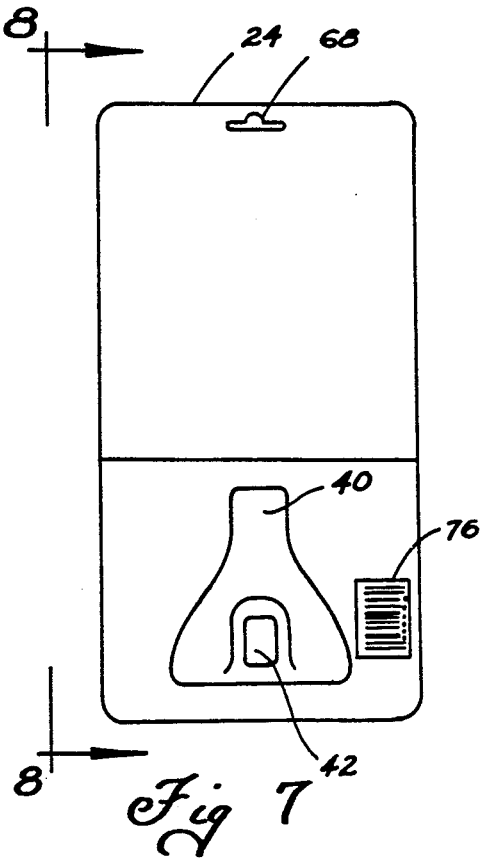
FIG. 7 is a view taken in the direction of arrows 7—7 in FIG. 5 after the first part of the packaging has been captured by the second part.

Each cavity 34, 38 has a general U-shape. They are however slightly elongated at the front of the mouthguard as at 40 in FIGS. 7 and 9 to accommodate the attachment of the strap 14 to the main body 12 and the looping of the strap back over the front of the mouthguard. Cavity 34 contains a small bubble 42 between the sides of the U for loop 20 while cavity 38 contains a somewhat larger bubble 44 between the sides of the U for loop 20. Cavity 38 also contains a small bubble 46 for the portion of the strap that passes over the top front portion of the mouthguard.

Figure 4:
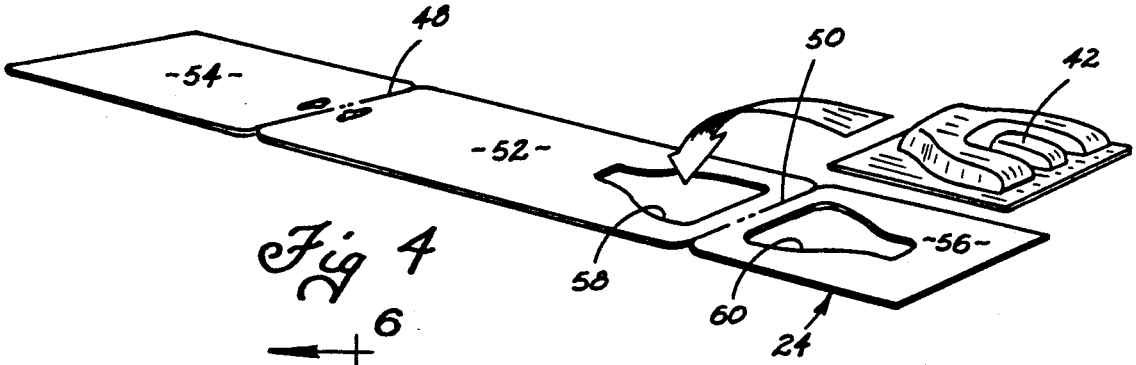
FIG. 4 is a perspective view illustrating a second part of the packaging and the manner in which the first part of the packaging is assembled to the second part.
Figure 6:
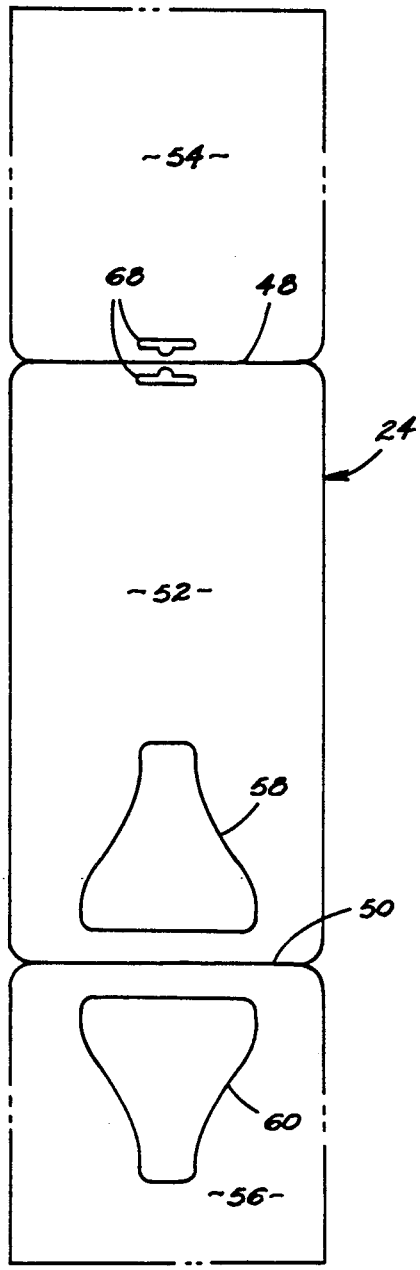
FIG. 6 is a view taken in the direction of arrows 6—6 in FIG. 5.

After the mouthguard has been placed into the clamshell, the clamshell can be assembled to the carrier 24. The carrier 24 is initially flat as seen in FIGS. 4 and 6. It is provided with two spaced apart, but parallel, lines of folding 48 and 50 which are perpendicular to the length if the carrier. Accordingly, the carrier may be considered to have a rectangular central region 52 having rectangular flaps 54, 56 at opposite ends. Central region 52 and flap 56 contain respective cut-outs 58 and 60 that are arranged symmetrically about fold line 50. These cut-outs are shaped to allow the two cavities 26, 28 to fit into them when the mouthguard-containing part 22 is placed in the manner indicated in FIG. 4 and the flap 56 folded back against the central region 52. The peripheral margins surrounding the cutouts 58 and 60 serve to sandwich the margins 32 and 36, but the margins do not extend to the edges of the central region 52 or of the flap 56. This allows for the outer perimeter of the flap to be adhered or otherwise joined to the central region 52 thereby securely entrapping the closed and hermetically sealed clamshell on the carrier part 24.

Figure 5:
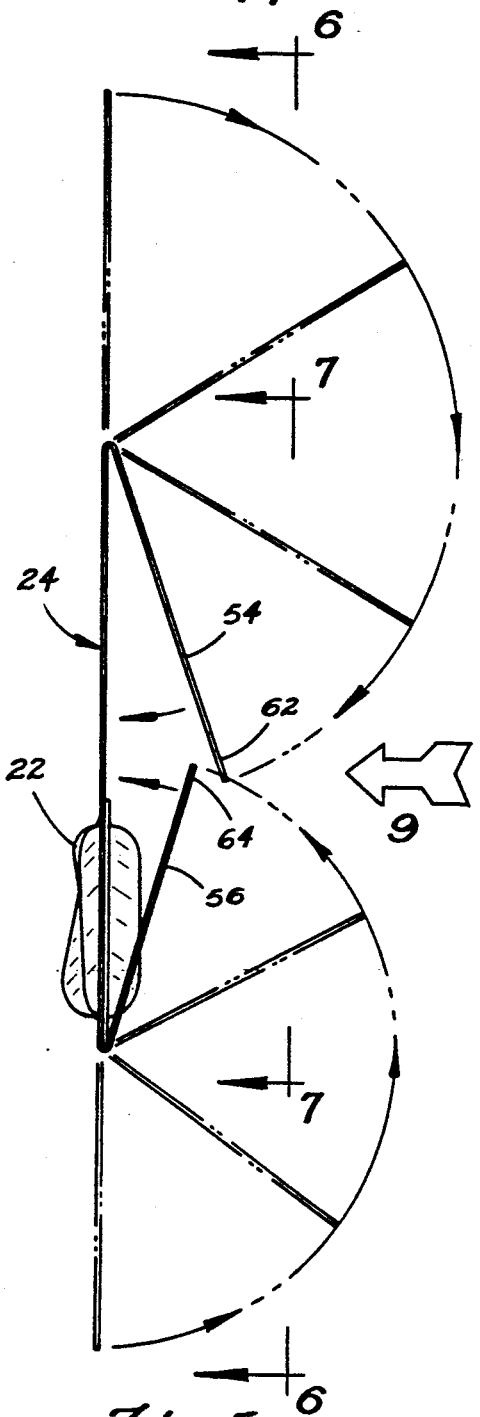
FIG. 5 is a side view illustrating the two parts of the packaging and more detail of the manner in which the first part is captured by the second part.

After that operation, the flap 54 can be folded back onto the same side of central region 52 as flap 56. Flap 56 is designed such that the distal edge 62 will slightly overlap the distal edge 64 of flap 56 as indicated by FIG. 5. The periphery of flap 54 is adhered or otherwise joined along its sides to the central region 52 and along its distal edge 62 to the distal edge of flap 64 to complete the packaging. Because of the manner in which the mouthguard is packaged, tampering with the package is likely to be self-evident.

Figure 8:
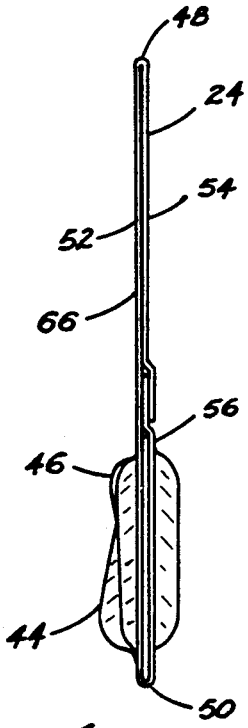
FIG. 8 is a view taken in the direction of arrows 8—8 in FIG. 7.

The packaging is advantageous because the complete mouthguard is exposed to viewing through the transparent clamshell, even though the mouthguard is itself hermetically sealed. The packaging is also advantageous from the standpoint of the information and printed matter that are carried on part 24. In particular, the face of carrier 24 that is opposite the face onto which the flaps are folded is preferably the front of the packaging. This front face, designated 66 in FIG. 8, can carry advertising information to draw attention to the product, and it can also carry the product's brand name. At the same time the packaged product can be seen in the enclosure. The carrier is provided with slots 68 that coincide with flap 54 in the folded condition, and these slots allow the packaged product to be conveniently racked for retail sale.

Figure 9:
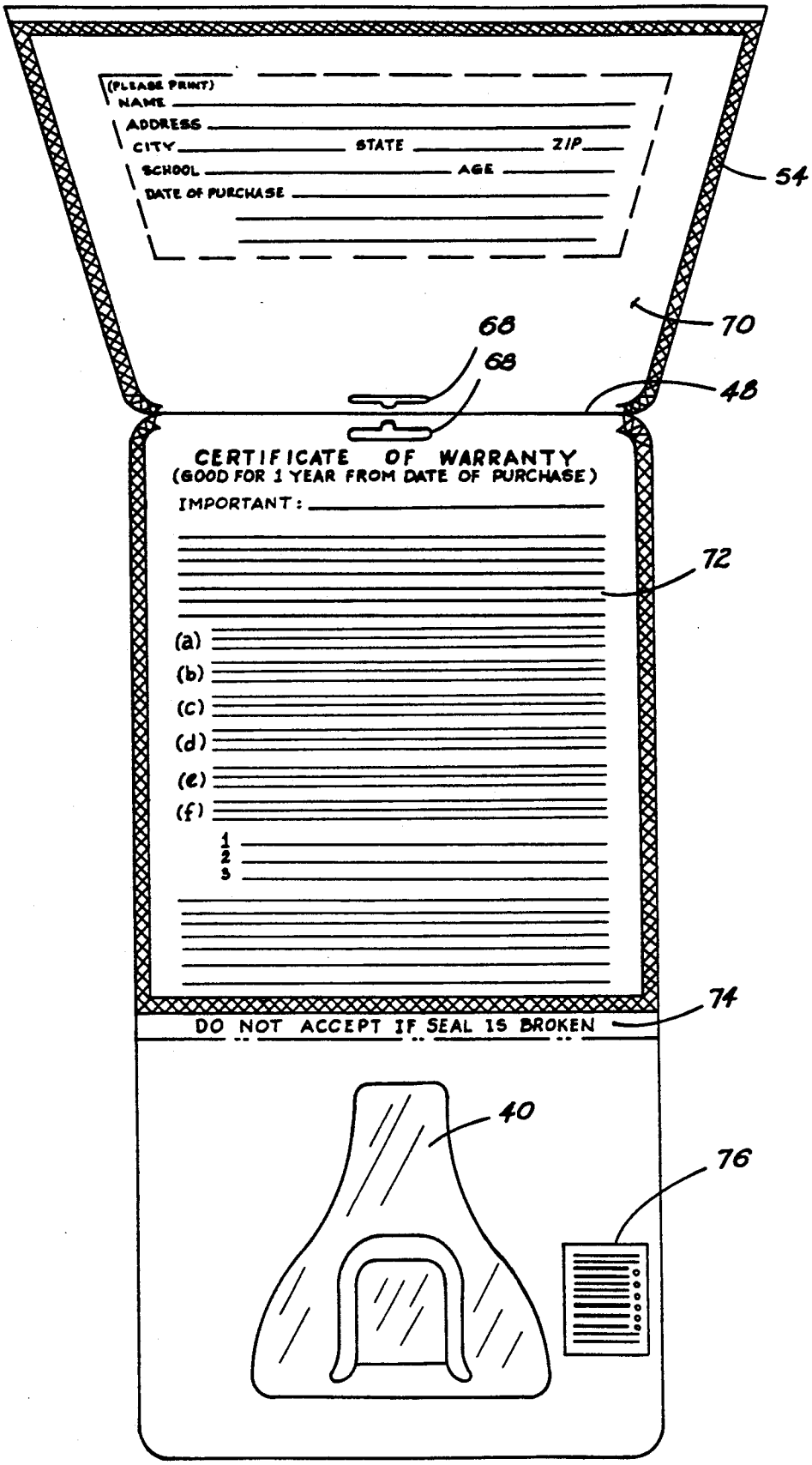
FIG. 9 is a perspective view in the direction of arrow 9 in FIG. 5 just before the packaging is completed.

Another important aspect involves the use of carrier 24 to provide warranty information. As can be seen in FIG. 9, the confronting sides of flap 54 and the upper portion of central region 52 are imprinted with a warranty registration card 70 and a certificate of warranty 72 respectively. By tearing the flap 54 along line 48, the warranty registration card can be detached and then completed and sent back to the manufacturer. The purchaser can keep the warranty certificate. If desired, a message alerting the purchaser against the contingency of the package having been tampered with can be included as illustrated at 74 in FIG. 9. It is also possible to place a UPC code 76 for the particular product on the exterior of flap 56, as shown in FIG. 9.

The mouthguard packaging of this invention can therefore be seen to possess many advantages and benefits. It provides an extremely presentable product in a way that enables the prospective purchaser to fully inform himself about the product, not only by reading information about the mouthguard, but also by being able to fully see the mouthguard from both sides. The mouthguard can be mass-merchandised while making tampering with the product self-evident. A prospective customer may be less likely to purchase a product that is used orally, if he believes that the product has been previously opened. A partially or fully torn packaging can indicate the possibility that the package has been previously opened, and since such will be self-evident from inspection, the prospective customer can refuse to accept a product in such an instance. The packaging also lends itself to vending by the sporting goods departments of mass-merchandising retailers. It is indeed an effective means for marketing this particular product.

While a presently preferred embodiment of the invention has been disclosed, it should be understood that principles of the invention are applicable to other embodiments.

What is claimed is:

1. A packaged mouthguard wherein the mouthguard is of the type which comprises a U-shaped body having a tethering strap extending away from a location at the front of the U-shaped body which is nearer a lower edge of the body than an upper edge of the body, said packaged mouthguard comprising a loop formed at the distal end of the tethering strap by looping the extreme distal end of the tethering strap back onto the strap, said loop being disposed to nest in the U-shaped body by being folded into an S-shaped curve which begins at a location spaced frontally from the front of the body, which extends over the upper edge of the body, and which ends by merging into the nested loop, and an enclosure enveloping the mouthguard and confining said strap so as to retain the strap folded in the S-shaped curve and the loop nested in the U-shaped body.

2. A packaged mouthguard as set forth in claim 1 wherein said enclosure is transparent plastic that enables the mouthguard to be seen from both sides of the enclosure.

3. A packaged mouthguard as set forth in claim 2 wherein said enclosure is in the form of a clamshell having two halves joined about a fold line, each of said halves having a corresponding cavity for receiving a corresponding portion of the mouthguard.

4. A packaged mouthguard as set forth in claim 3 wherein at least one of said cavities includes a bubble within which a portion of the nested loop of the strap is disposed.

5. A packaged mouthguard as set forth in claim 4 wherein both of said cavities contain bubbles within which respective portions of the nested loop of the strap are disposed.

6. A packaged mouthguard as set forth in claim 4 wherein said cavities contain opposing bubbles that serve to capture the loop of the strap.

7. A packaged mouthguard wherein the mouthguard is of the type which comprises a U-shaped body having a tethering strap extending away from the front of the U-shaped body, said packaged mouthguard comprising a loop formed at the distal end of the tethering strap by looping the extreme distal end of the tethering strap back onto the strap, said loop being disposed to nest in the U-shaped body, and an enclosure enveloping the mouthguard to retain the loop nested in the U-shaped body, wherein said enclosure is transparent plastic that enables the mouthguard to be seen from both sides of the enclosure, said enclosure is in the form of a clamshell having two halves joined about a fold line, each of said halves having a corresponding cavity for receiving a corresponding portion of the mouthguard, including a carrier for the clamshell, said carrier comprising a central portion and a flap that are joined along a line of folding, said central portion and said flap containing cutouts that are symmetrical about the carrier's line of folding, said clamshell fitting into said cutout's so as to be entrapped between said central portion and said flap when the flap is folded about the carrier's line of folding back onto said central portion of the carrier.

8. A packaged mouthguard as set forth in claim 7 wherein said carrier further includes a second flap that joins to said carrier about a further line of folding that is spaced from, but parallel to, the carrier's first-mentioned line of folding, said second flap being folded back onto the same side of the carrier as the first flap.

9. A packaged mouthguard as set forth in claim 8 wherein the confronting surfaces of the second flap and the central portion of the carrier contain a warranty registration card for the mouthguard and a warranty certificate for the mouthguard respectively.

10. A packaged mouthguard as set forth in claim 9 wherein the warranty registration card is disposed on said further flap and said warranty certificate is disposed on said central portion of the carrier.

11. A packaged mouthguard as set forth in claim 10 wherein the side of the central portion of the carrier onto which the flaps are not folded contains descriptive indicia about the mouthguard.

12. A packaged mouthguard as set forth in claim 9 including aligned apertures in said central portion of the carrier and said further flap that allow for the carrier to be pendently supported for rack display.

13. A packaged mouthguard comprising a transparent enclosure ensealing a mouthguard, said enclosure having a peripheral margin, a carrier having cut-outs that are symmetrical about a line of folding by which a flap of the carrier joins with another portion of the carrier, said enclosure fitting into said cut-outs such that said peripheral margin of the enclosure is sandwiched between said flap and said another portion of the carrier when said flap is folded onto said another portion of the carrier about said line of folding.

14. A packaged mouthguard as set forth in claim 13 wherein said carrier further includes a second flap that joins to said carrier about a further line of folding that is spaced from, but parallel to, the carrier's first-mentioned line of folding, said second flap being folded back onto the same side of the carrier as the first flap.

15. A packaged mouthguard as set forth in claim 14 wherein the confronting surfaces of the second flap and the central portion of the carrier contain a warranty registration card for the mouthguard and a warranty certificate for the mouthguard respectively.

16. A packaged mouthguard as set forth in claim 15 wherein the warranty registration card is disposed on said further flap and said warranty certificate is disposed on said central portion of the carrier.

17. A packaged mouthguard as set forth in claim 16 wherein the side of the central portion of the carrier onto which the flaps are not folded contains descriptive indicia about the mouthguard.

18. A packaged mouthguard comprising a transparent enclosure ensealing a mouthguard, said enclosure having a peripheral margin, a carrier to which said enclosure is mounted via said peripheral margin, wherein said carrier includes a flap that joins to said carrier about a line of folding, said flap being folded back onto the carrier, the confronting surfaces of the flap and a central portion of the carrier contain a warranty registration card for the mouthguard and a warranty certificate for the mouthguard respectively.

19. A packaged mouthguard as set forth in claim 18 wherein the warranty registration card is disposed on said flap and said warranty certificate is disposed on said central portion of the carrier.

20. A packaged mouthguard as set forth in claim 19 wherein the side of the central portion of the carrier onto which the flap is not folded contains descriptive indicia about the mouthguard.

* * * * *